US005651610A

United States Patent [19]

Fadel

[11] Patent Number: 5,651,610

[45] Date of Patent: Jul. 29, 1997

[54] MOTOR VEHICLE HEADLAMP FOR EMITTING A LIGHT BEAM DELIMITED BY A CUT-OFF LINE IN TWO HALF PLANES OFFSET IN HEIGHT FROM EACH OTHER

[75] Inventor: Kamislav Fadel, Pantin, France

[73] Assignee: Valeo Vision, Bobigny Cedex, France

[21] Appl. No.: 628,571

[22] Filed: Apr. 4, 1996

[30] Foreign Application Priority Data

Apr. 6, 1995 [FR] France ..... 95 04109

[51] Int. Cl.[6] ..... F21V 7/00

[52] U.S. Cl. ..... 362/297; 362/346; 362/348

[58] Field of Search ..... 362/297, 61, 346, 362/348

[56] References Cited

U.S. PATENT DOCUMENTS

| | | | |
|---|---|---|---|
| 3,858,040 | 12/1974 | Ricard . | |
| 4,481,563 | 11/1984 | Snyder et al. . | |
| 4,797,797 | 1/1989 | Collot | 362/348 |
| 4,803,601 | 2/1989 | Collot et al. . | |
| 4,924,359 | 5/1990 | Lhydaz et al. | 362/297 |
| 5,390,097 | 2/1995 | Nino | 362/346 |
| 5,539,629 | 7/1996 | Chinniah et al. | 362/297 |

FOREIGN PATENT DOCUMENTS 2609148 1/1988 France .

*Primary Examiner*—Carroll B. Dority
*Attorney, Agent, or Firm*—Morgan & Finnegan, L.L.P.

[57] ABSTRACT

A headlamp for a motor vehicle has a lamp with an axial filament which emits light all around it, together with a reflector and a cover glass. The reflector produces a beam which is delimited by a cut-off line defined by two half planes which are offset from each other in the vertical direction, and which lie on either side of a vertical reference plane. A first lateral zone of the reflector has a reflective surface which forms a concentrated beam delimited by a straight, horizontal first cut-off line, situated entirely on one side of the vertical reference plane. A second zone of the reflector, extending over the base surface of the latter and on the opposite side, has a reflective surface which produces a wide beam delimited by a straight and horizontal second cut-off line. The reflector also includes means for offsetting the light beam vertically, such as to put the first cut-off line at the level of the higher cut-off half plane, and the two zones of the reflector are joined continuously at their intersection along a continuous line extending between the upper and lower edges of the reflector.

7 Claims, 11 Drawing Sheets

MOTOR VEHICLE HEADLAMP FOR EMITTING A LIGHT BEAM DELIMITED BY A CUT-OFF LINE IN TWO HALF PLANES OFFSET IN HEIGHT FROM EACH OTHER

FIELD OF THE INVENTION

The present invention relates in general terms to a motor vehicle headlamp of the type which is capable of emitting a chopped light beam which conforms, in particular, to the laws of the United States of America as laid down in American standard SAE J 579 C.

BACKGROUND OF THE INVENTION

United States patent specification No. 3,858,040, in the name of the present Applicant or an assignee of the present Applicant, defines a cut-off profile which enables the above standard to be complied with. This cut-off line is defined by two horizontal half planes P1 and P2 which are offset from each other in height, with the right hand half plane being offset upwardly for use when driving on the right, and by an oblique junction zone in the vicinity of the axis defining the direction of travel.

The same United States patent specification also discloses a headlamp having a reflector of the parabolic type which enables this cut-off line to be generated, with a filament which is provided with an occulting shield or mask that enables a light beam to be produced which is chopped in a horizontal plane.

This headlamp also has a cover glass which is provided with prisms for raising the images of the filament lying on one side, so as to define the raised cut-off half plane P2. It will be understood that, because the occulting shield cuts out about one half of the light emitted, this headlamp only produces a rather weak light output.

It is also known, from French patent specification No. FR 2 583 189A, to provide a headlamp which is capable of producing, with a filament which has no occulting shield, and by virtue of a specific design of the reflector, the same type of cut-off line. In one embodiment of that headlamp, it is necessary to arrange prisms on the cover glass so as to obtain the two offset half cut-off lines. In another embodiment of the same headlamp, this offset is obtained by means of an angular offset of certain regions of the reflector with respect to others, in such a way that the reflector has undesirable interruptions which give rise to optical anomalies.

Finally, French patent specification No. FR 2 599 120A, which is again in the name of the Applicant or an assignee of the Applicant, discloses a headlamp which is capable, again with the aid of a reflective surface which has no discontinuity, of producing a light beam which has the same type of cut-off line, and in which the pool of concentration of light in the beam is offset laterally with respect to the axis of the filament and reflector.

However, in these various known types of headlamp, the light beam which is produced by the bare reflector remains relatively narrow, and major adjustment is required in the region of the cover glass.

DISCUSSION OF THE INVENTION

An object of the present invention is to provide a novel headlamp which enables a beam to be produced which not only has the required cut-off line of the type described above, but which also, without relying on the cover glass, gives a very wide beam, all this being obtained with the aid of a reflector having a reflective surface which is continuous, and which preferably has no sharp changes of slope.

A further object of the invention is to achieve the above mentioned objects while also obtaining a light beam of satisfactory homogeneity.

According to the present invention, a headlamp for a motor vehicle, of the type comprising a lamp having an axial filament for emitting light freely all around it, a reflector, and a cover glass, in which the reflector is adapted to generate, in cooperation with the filament, a light beam delimited by a cut-off line which is defined essentially by two half planes offset in height from each other and situated on either side of a vertical reference plane, is characterised in that it includes, in a first zone of the reflector extending along a lateral edge of the latter and over its whole height, a reflective surface which is capable of forming a concentrated beam delimited by a generally straight and horizontal first cut-off line and situated entirely on one side of the said vertical reference plane, and, in a second zone of the reflector, extending from the base of the latter and as far as an opposed lateral edge, a further reflective surface capable of producing a wide light beam delimited by a generally straight and horizontal second cut-off line, in that the reflector includes means for offsetting the light beam vertically, which means are adapted to position the said first cut-off line at the level of the higher cut-off half plane, and in that the two said zones are joined continuously together at the level of the intersection of the respective said surfaces, along a continuous line extending between the upper and lower edges of the reflector.

Certain preferred features of the invention, or features characterising different embodiments of the invention, all of which are however not limiting, are as follows.

Each said reflective surface preferably produces images of the filament, the highest points of which are situated close to the respective cut-off line.

The means for offsetting the light beam vertically may comprise a tilting of the said first zone through a predetermined vertical angle.

Alternatively, the means for offsetting the light beam vertically may comprise a set of striations formed on a smooth base surface of the said first zone of the reflector, at least part of the said striations defining an offset of level with respect to the said base surface between their upper ends and their lower ends.

The reflector preferably has an overall base surface consisting of: a first base surface of the said first zone; the surface of the said second zone at the level of the base of the reflector; and a second base surface which is essentially symmetrical with the said first base surface with respect to a vertical axial plane. Preferably, a first set of striations then constitutes the said means for offsetting the light beam vertically at the level of the first or second base surface, with a second set of striations constituting means for widening the light beam horizontally at the level of the second or first base surface, in such a way that light beams for use when driving on the right and for driving on the left may be produced using a common overall base surface.

The reflector is preferably made by moulding in a plastics material, using a mould which has a common mould cavity for reflectors adapted for use when driving on the left and mirrors adapted for use when driving on the right.

The cover glass is preferably smooth or only slightly capable of diverting the light.

Further features, objects and advantages of the present invention will appear more clearly on a reading of the following detailed description of preferred embodiments of the invention, which is given by way of non-limiting example only and with reference to the accompanying drawings.

DESCRIPTION OF PREFERRED EMBODIMENTS OF THE INVENTION

It will first be noted that, as between one Figure and another of the drawings, those elements or portions which are identical or similar to each other are designated, as far as possible, by the same reference signs. It will also be noted that, on the various diagrams showing light beams in terms of curves of constant luminous intensity, the numerical indications are given in degrees. In addition, the horizon line is designated as HH, while a central, vertical reference plane is indicated at VV.

Figure 1:
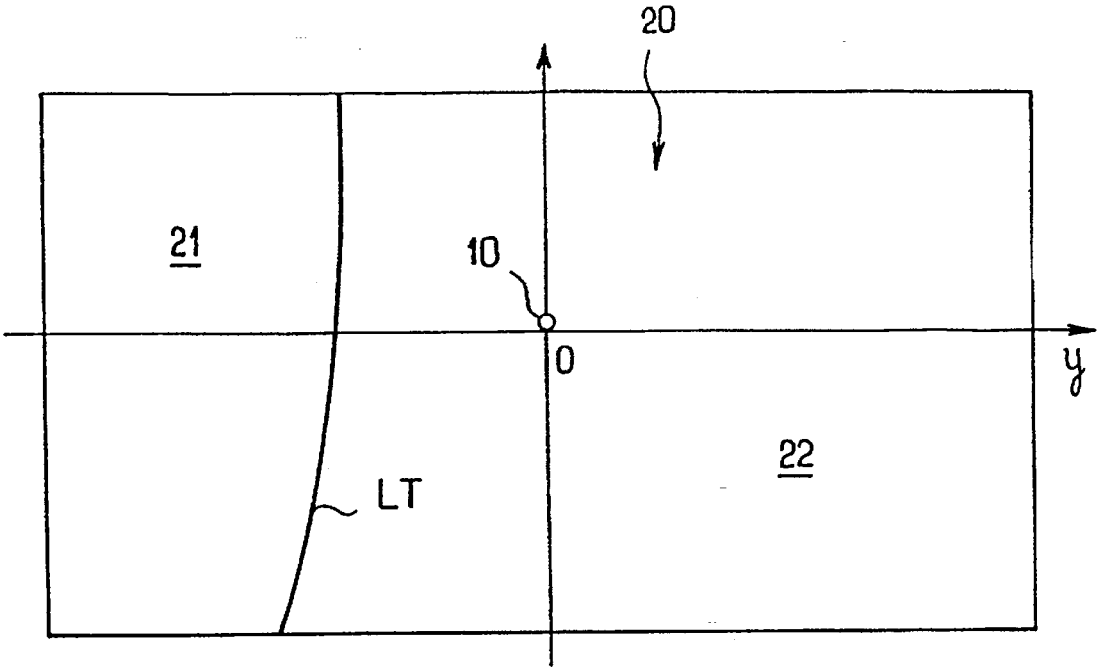
FIG. 1 is a projected front view of a reflector for a headlamp in accordance with the present invention, with an associated lamp filament.
Figure 2:
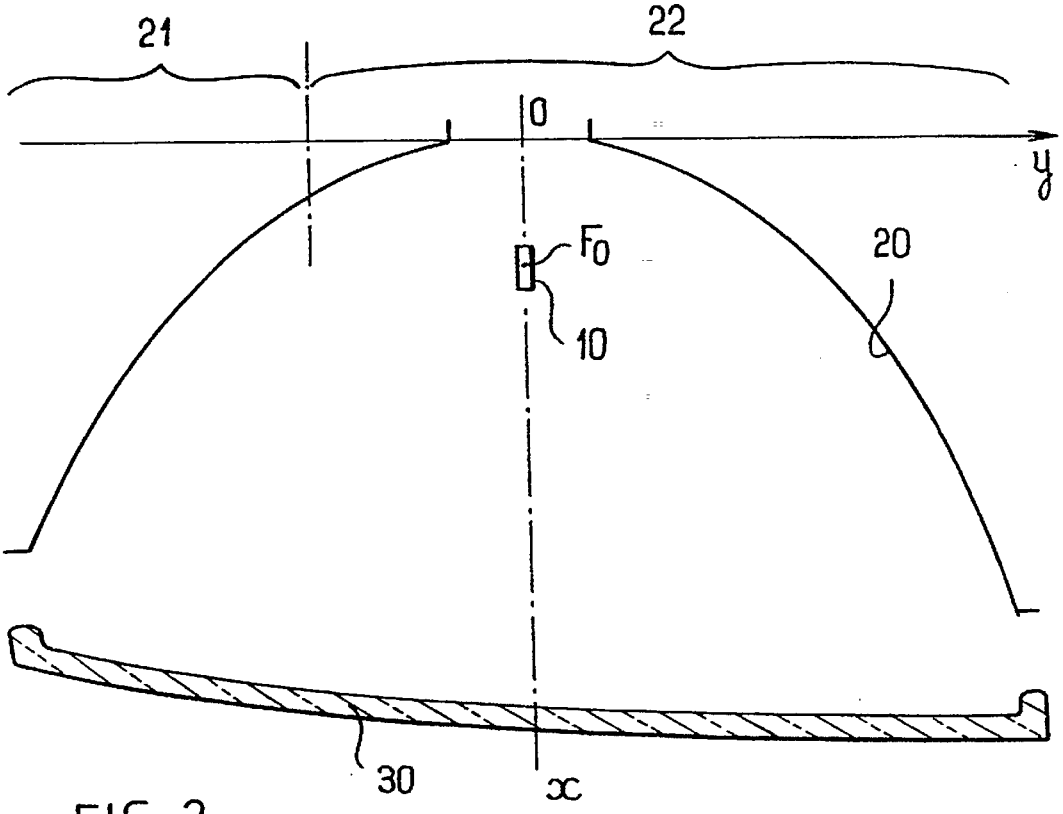
FIG. 2 is a view in horizontal axial cross section, showing the reflector and filament of FIG. 1, together with a cover glass of the headlamp.

Reference is first made to FIGS. 1 and 2, which show a motor vehicle headlamp comprising a reflector 20 which will be described in detail later herein, together with a lamp which is mounted in the base of the reflector and which has an axial filament 10. The headlamp also has a cover glass 30.

In the present case, the lamp is a normalised lamp of type 9006, which is used in particular in the United States of America. Its filament is such as to emit light freely all around it, with only a frontal screen or mask of the lamp serving to occult direct light. The reflector is capable by itself of producing a light beam which is delimited by a cut-off line, of the kind mentioned in the present description earlier herein under the heading "Background of the Invention".

The following description of the reflector of FIGS. 1 and 2 relates to a light beam for use when driving on the right hand side of the road, that is to say the right hand cut-off half plane is raised above the level of the left hand cut-off half plane. To this end, the reflector has a first zone 21 which is defined by a surface capable of producing images of the filament 10, all of which lie below a horizontal cut-off line; and the higher points of the images are preferably situated close to this cut-off line. The said surface at the same time directs these images to one side (in the present case the right hand side) of the vertical reference plane VV.

It will be understood that, due to the position of the zone 21 with respect to the source 10, the images produced by the zone 21 are, on the one hand, relatively small in size, and secondly they are inclined to the horizontal by a reasonably small amount. As a result, the surface 21 is capable of producing a relatively thin pool of concentration of light, which is offset laterally with respect to the plane VV which lies below a horizontal half cut-off line. For example, in order to have the above mentioned properties, the reflective surface of the zone 21 is made either in accordance with the equation set out on page 5 of French patent specification No. FR 2 583 139A, or, more preferably, in conformity with the equations on page 10 of French patent specification No. FR 2 599 120A. Both of these two specifications are those of patent applications in the name of the present Applicant or an assignee of the present Applicant.

In the first of the above two cases, the surface is tilted, or inclined, horizontally by the amount necessary for offsetting the light beam towards the right (for driving on the right hand side). This offset is a function of the width of the portion of the light beam concerned, and corresponds to about one half of that width. In the second case mentioned above, the reflective surface is adapted in itself to put the light beam into the right hand part of the projection plane, and no tilting is necessary.

Figure 3A:
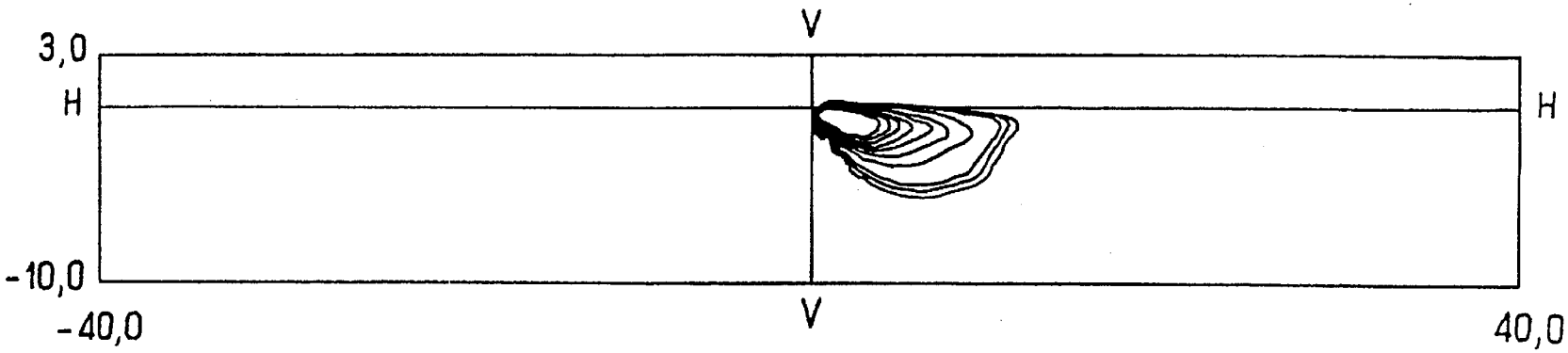
FIGS. 3*a* and 3*b* show, by means of a set of curves along which the luminous intensity is constant, the light which is given by two different zones of the reflector of FIGS. 1 and 2 in the absence of the cover glass.

The illumination obtained by the zone 21, having a surface in conformity with the second case above, is illustrated by a set of curves of constant luminous intensity in FIG. 3*a*. It has a generally straight cut-off line at the level of the horizon line HH, and lies immediately to the right of the vertical reference plane VV.

The reflective surface of the zone 22, which occupies the base of the reflector on the opposite side of the latter from the zone 21, is a surface which is adapted to produce a very wide beam defining a horizontal cut-off line. Preferably, the highest points of the images of the filament that are produced lie close to this cut-off line. In order to obtain a large beam width combined with good homogeneity in the horizontal direction, it is advantageous to make this surface in accordance with either the mathematical equations given in French patent specification No. FR 2 639 888A (see the zones 210, 220 and 230 in FIG. 5 of that document), or and preferably, the equations mentioned in French patent specification No. FR 2 664 677A relating to reflector zones 201, 202 and 203 described in that document.

Figure 3B:
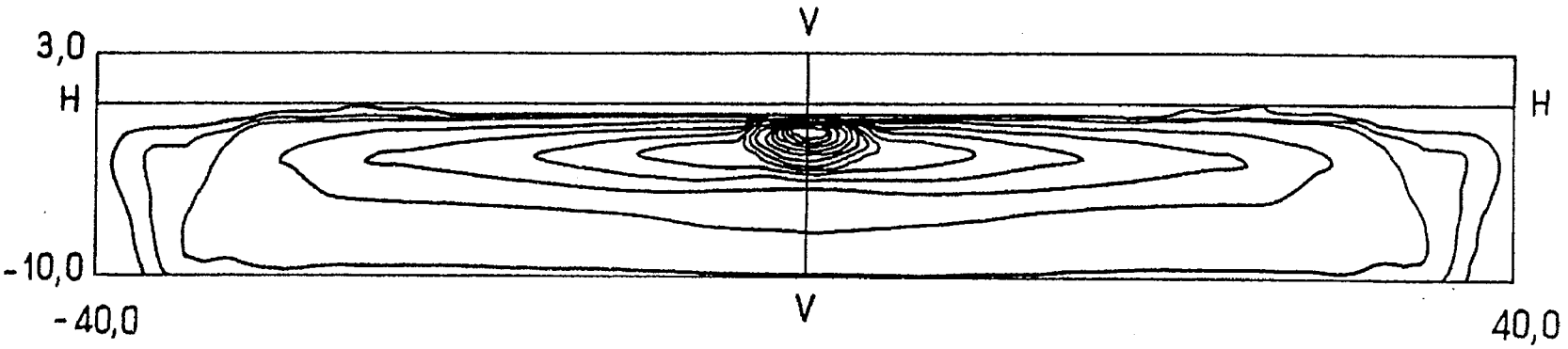

The portion of the light beam produced by the zone 22 is shown in FIG. 3*b*. It will be observed that the straight cut-off line which is produced lies slightly lower, being for example lower by 0.7 degrees, than the cut-off line of the beam produced by the zone 21. To this end, in terms of its mathematical definition in the three-dimensional reference frame (o, x, y, z), the zone 22 is inclined downwardly by 1.5 degrees.

In order to prevent any separation between the surfaces of the two zones 21 and 22 that would normally be due to the horizontal tilting or deflection mentioned above, the parameters of these surfaces, and more particularly their base focal distance, is so calculated that the intersection of the two surfaces, for which a horizontal deflection of one with respect to the other has been determined beforehand by adjustment of their governing equations, lies along a transition line which is indicated at LT in FIG. 1. This line LT extends generally vertically between the upper and lower edges of the reflector 20. As a result, the reflector does not have any interruption of its continuity. It only has a very slight curve in the region of the transition line LT, and this curve can in practice be eliminated during the operations of polishing the mould part or piston of the mould in which the optically active side of the reflector is made.

Figure 3C:
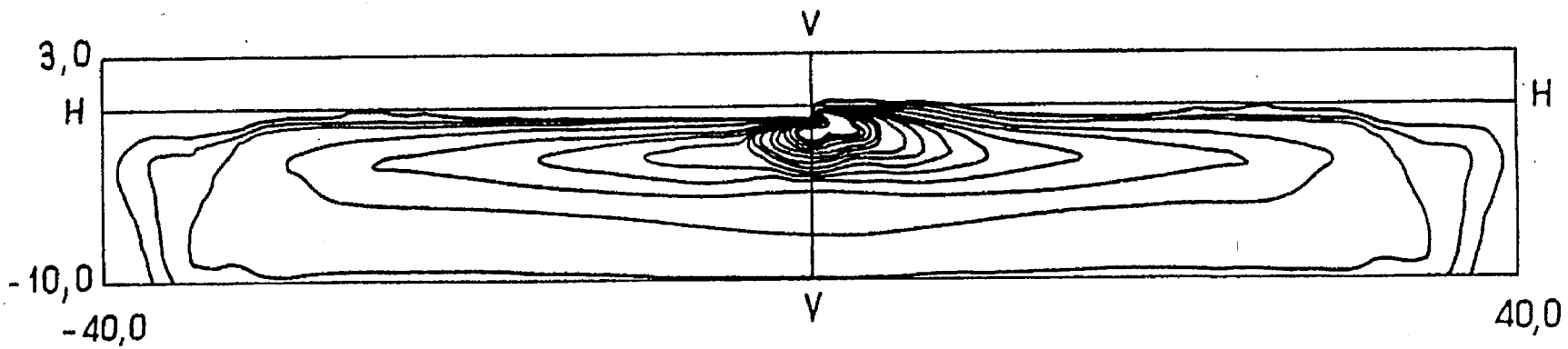
FIG. 3*c* shows, by means of sets of curves along each of which the luminous intensity is constant, the light given by the reflector of FIGS. 1 and 2 as a whole, in the absence of the cover glass.

The overall light beam which is obtained with this reflector is indicated by the curves of constant luminous intensity seen in FIG. 3*c*. Here the offset can be seen between the half planes which define the left and right hand cut-off lines, from the vertical reference plane W. It will also be observed that the light beam is very wide, and also very homogeneous. It displays a pool of light concentration which is situated immediately below the cut-off line, and which is slightly offset towards the right.

As a result, the cover glass of the headlamp can in practice be without any means for deflecting the light, such as striations, prisms and so on, and can be smooth.

Figure 4:
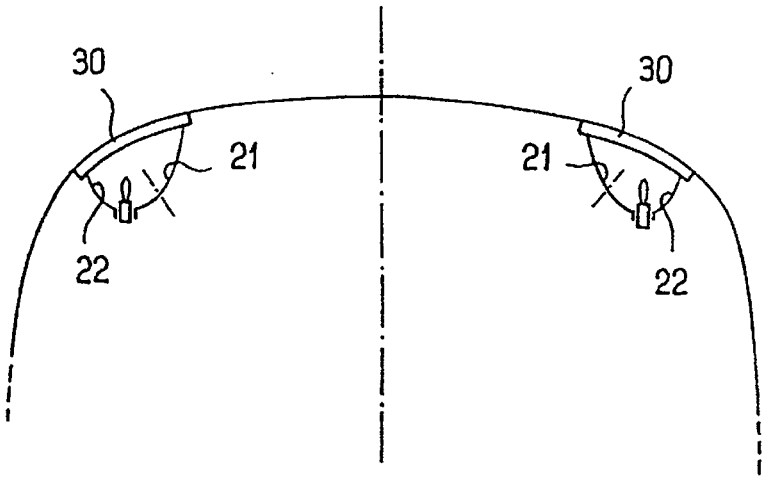
FIG. 4 is a diagrammatic plan view, in horizontal cross section, of the front part of a vehicle having two headlamps in accordance with the invention.

In addition, although FIGS. 1 and 2 show a reflector in which, in front elevation, the zone 21 lies on the left, the opposite arrangement may of course be retained. In particular, and as is seen in FIG. 4, it can be arranged that the reflector of a headlamp for use when driving on the left has its zone 21 on the left hand side (when seen from the front), and that the reflector of a headlamp for use when driving on the right has the zone 21 on the right hand side (again as seen from the front). This arrangement is of particular advantage when, as is shown in FIG. 4, the reflector has, due to the rounded profiles of the front part of the vehicle, an inner edge which is extended upwardly substantially more than its outer edge. In this way, each zone 21 can be given a high surface area while keeping it at a relatively great distance from the light source. This improves the intensity of the pool of light concentration in the light beam.

Although the description thus far is of a reflector which is adapted for a vehicle intended for driving on the right, that is to say with the right hand cut-off line raised and the pool of light concentration being offset towards the right, the person skilled in the art will be able to carry out the necessary modifications in order to produce an identical light beam for driving on the left hand side of the road (as is the case for example with the regulations in force in Japan). In practice, the reflector for use when driving on the left is the mirror image of the reflector used when driving on the right.

However, it may be desired to make mirrors which are for use indifferently when driving on the left and on the right hand side of the road, by moulding in a plastics material using the same mould cavity or pocket. This then gives rise to the difficulty which is linked to the asymmetry of the reflector. As is shown diagrammatically in FIGS. 5*a* and 5*b*, to which reference is now made, in which the dimension along the optical axis xx is exaggerated in the interests of clarity, a mould, having a common mould cavity 100, is made with two separate movable mould parts or pistons 102*a* and 102*b*. These two mould parts define the respective reflective surfaces for a light beam for use when driving on the right and for a light beam for driving on the left.

Figure 5A:
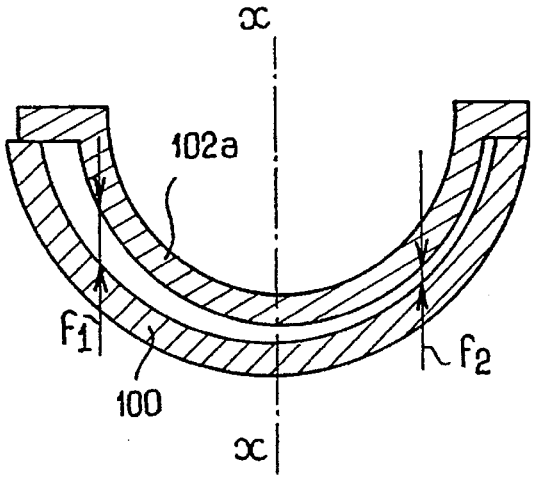
FIGS. 5*a* and 5*b* show in diagrammatic cross section two moulds for making reflectors for headlamps intended for driving on the left and for driving on the right, respectively.
Figure 5B:
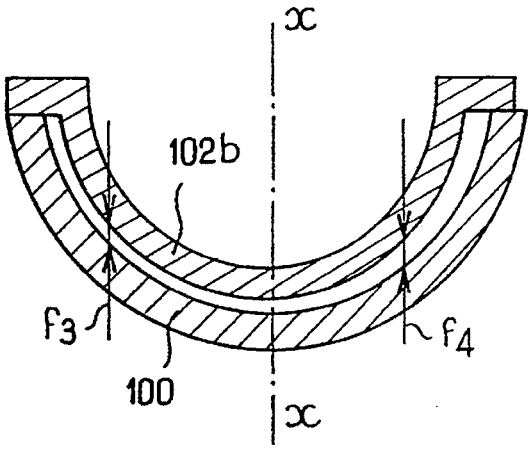

It will be noted that, because of the asymmetry of the reflective surface with respect to the optical axis xx, there is substantial variation in the width of the mould cavity as exemplified by the distances f1 to f4 indicated in FIGS. 5*a* and 5*b*. These variations are undesirable, both in terms of the behaviour of the reflector when brought to its operating temperature (giving rise to irregular deformations and malformation in the light beam) and in terms of economy, since a large amount of plastics material is used. These constraints do in fact currently lead to the design and manufacture of two separate mould cavities.

In order to overcome these drawbacks, the present invention further proposes to produce light beams of the type mentioned above, that is to say those having two half cut-off lines which are offset from one another in terms of height, and which are intended for driving on the right and on the left respectively, by obtaining the functions devolved on the zones 21 and 22 in the embodiment of FIGS. 1 and 2 by means of specific striation of certain zones of the reflective surface.

Figure 6:
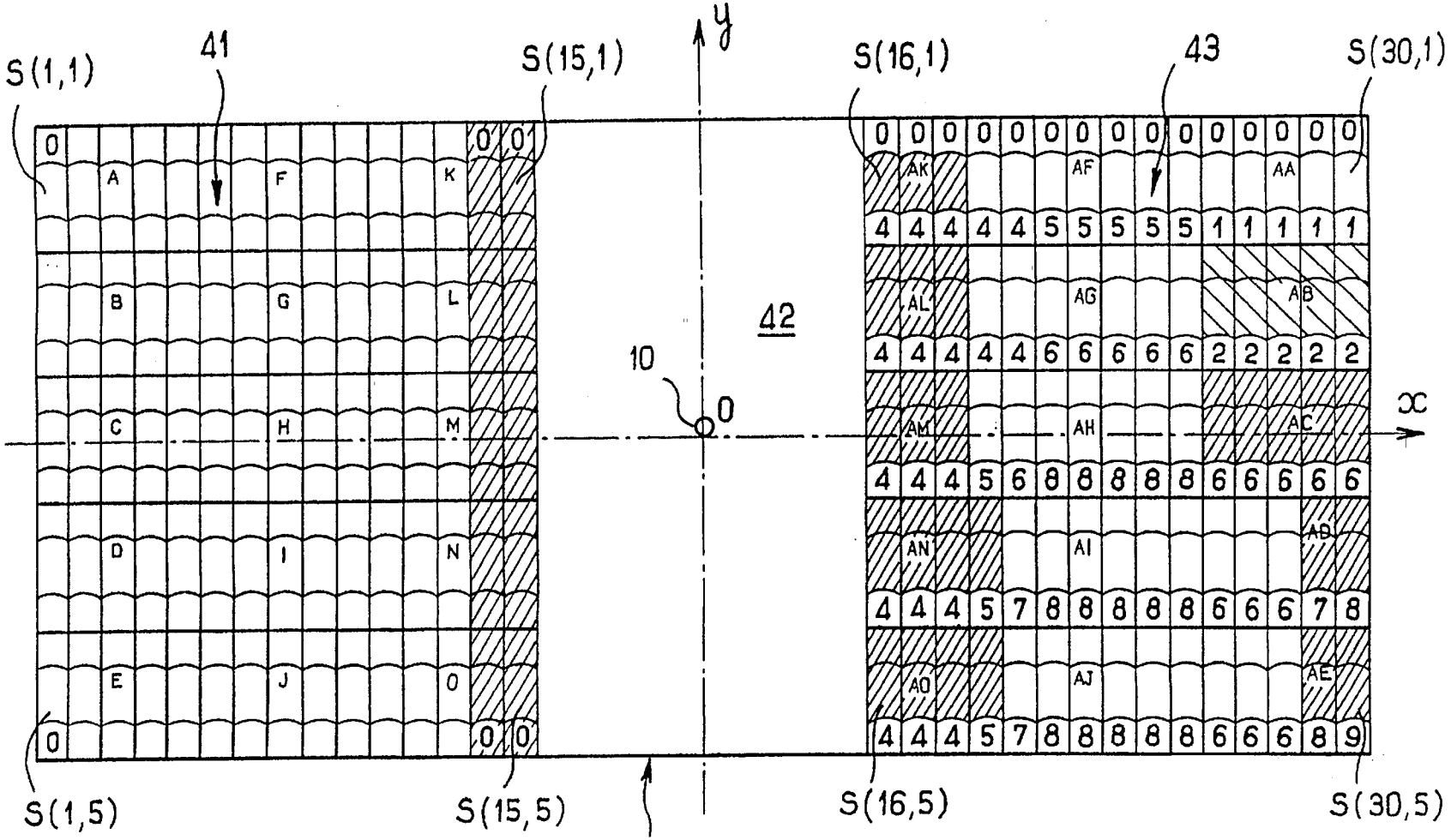
FIG. 6 is a front view of a reflector in another embodiment of the invention.

More particularly, and referring now in this connection to FIG. 6, this shows a reflector 40 which is divided into three zones 41, 42 and 43, namely two lateral zones 41 and 43 separated by a central zone 42. The central zone 42 has, over its whole area, the same surface as the central zone 22 of the reflector 20 in FIGS. 1 and 2. The lateral zone 41 has a base surface which is identical to the reflective surface of the zone 21 in FIGS. 1 and 2. As to the other lateral zone 43, this has a surface which is symmetrical with that of the zone 41.

A reflector is thus obtained which has a symmetrical base surface. As will be seen later herein, this enables the problem discussed above with reference to FIGS. 5*a* and 5*b* to be overcome. It will be noted here that the surfaces of the zones 41, 42 and 43 are not inclined vertically with respect to each other, that is to say the horizontal cut-off lines produced by these surfaces are aligned with each other.

Figure 7A:
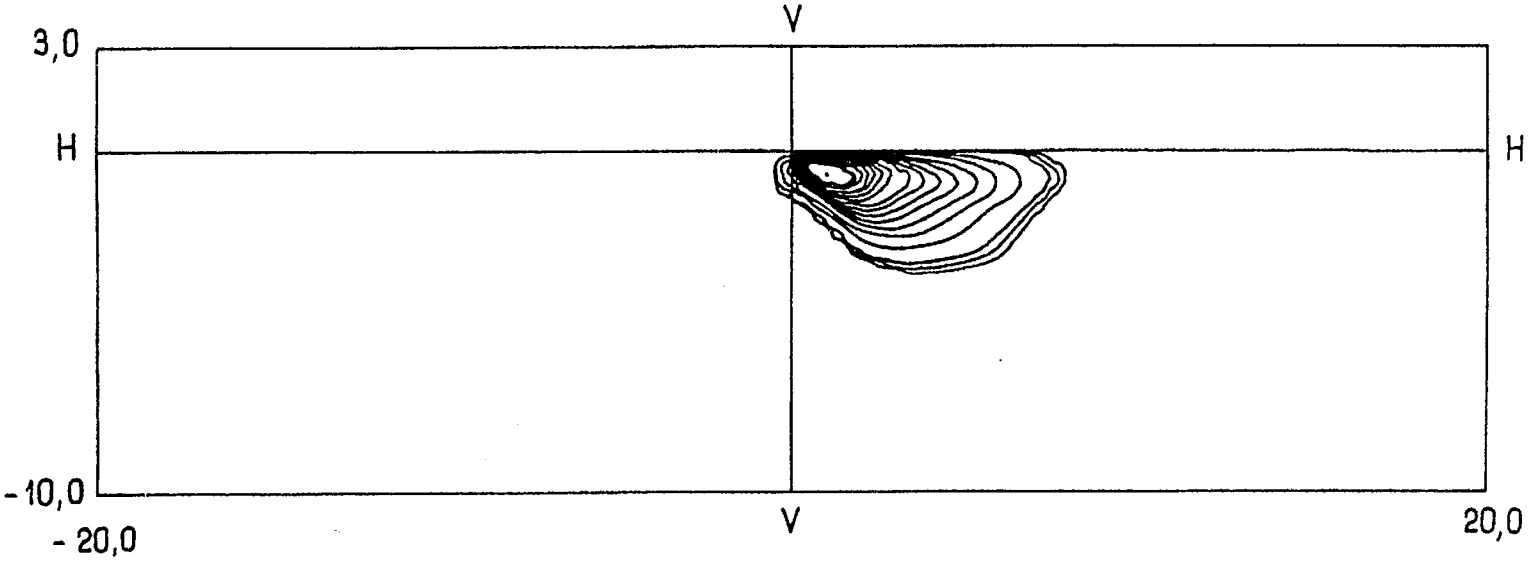
FIGS. 7*a* to 7*c* show, by means of three sets of curves along each of which the luminous intensity is constant, the portions of light beams which are produced by three base surfaces, which do not have striations, in the reflector of FIG. 6 in the absence of the cover glass.

With reference now to FIG. 7*a*, this shows the light distribution which would be obtained with the base surface of the zone 41. This distribution is naturally substantially identical with that in FIG. 3*a*.

Figure 7B:
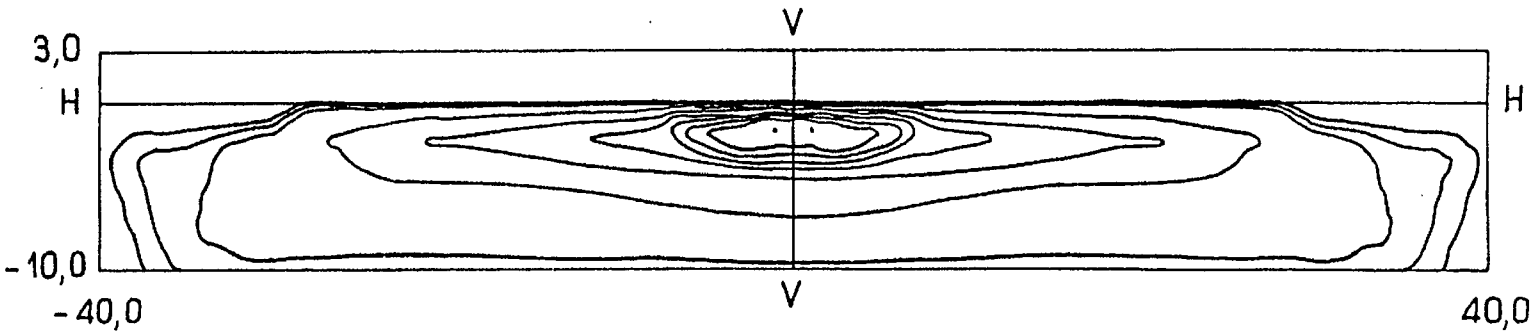

FIG. 7*b* shows the light distribution which is obtained with the surface of the zone 42, which has great similarities with that shown in FIG. 3*b* due to the fact that the surface of the zone 42 corresponds to a substantial part of the surface of the zone 22 in FIGS. 1 and 2.

Figure 7C:
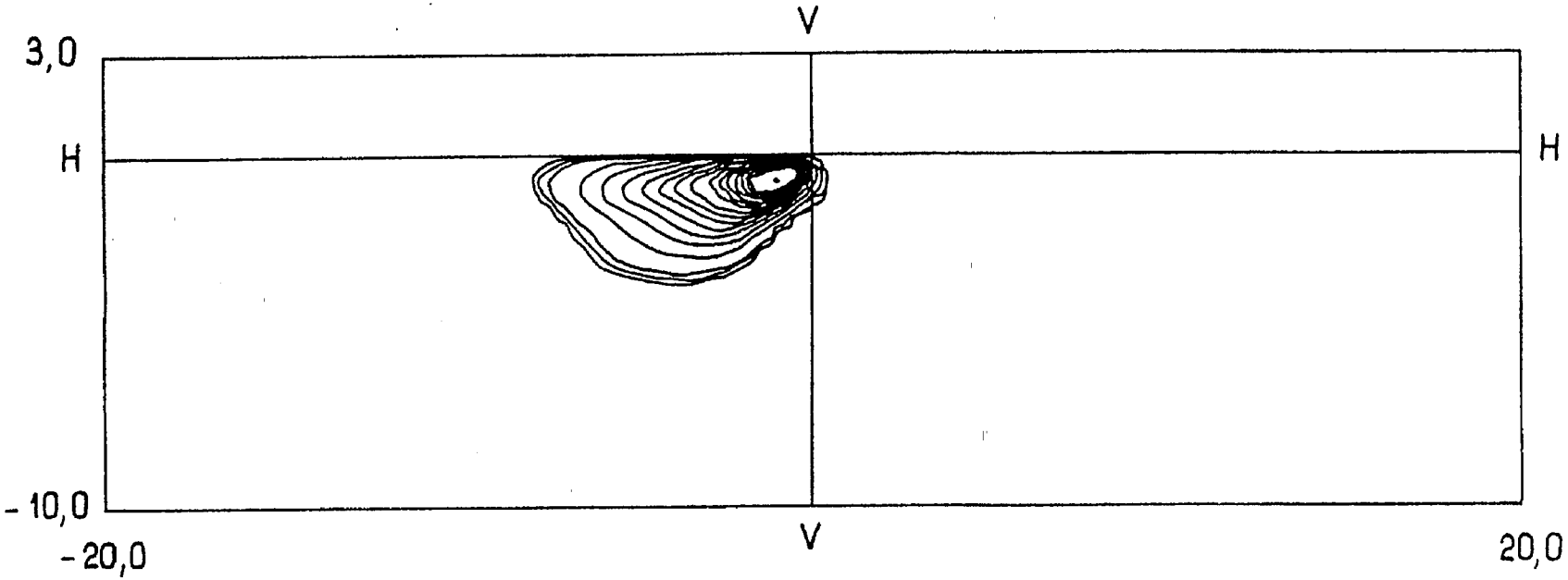

Reference is now made to FIG. 7*c*, which shows that, due to the symmetry of the surfaces of the zones 41 and 43, the light distribution which would be given by the zone 43 is symmetrical with that which the zone 41 will give.

As has been mentioned already, the base surface described above is modified by appropriate striations, and more precisely by two types of striations in the zones 41 and 43, in such a way as to obtain, selectively, either a cut-off line which is adapted for driving on the left, for example as in Japan, or a cut-off line which is adapted for driving on the right, as for example in the United States of America. In both cases, the central zone 42 remains smooth.

In the remainder of this description, the case of a reflector for driving on the left will be used by way of example.

In the present example, all of the striations have the same width and the same height and are separated, when projected on a plane at right angles to the optical axis, by horizontal and vertical limits.

Figure 8:
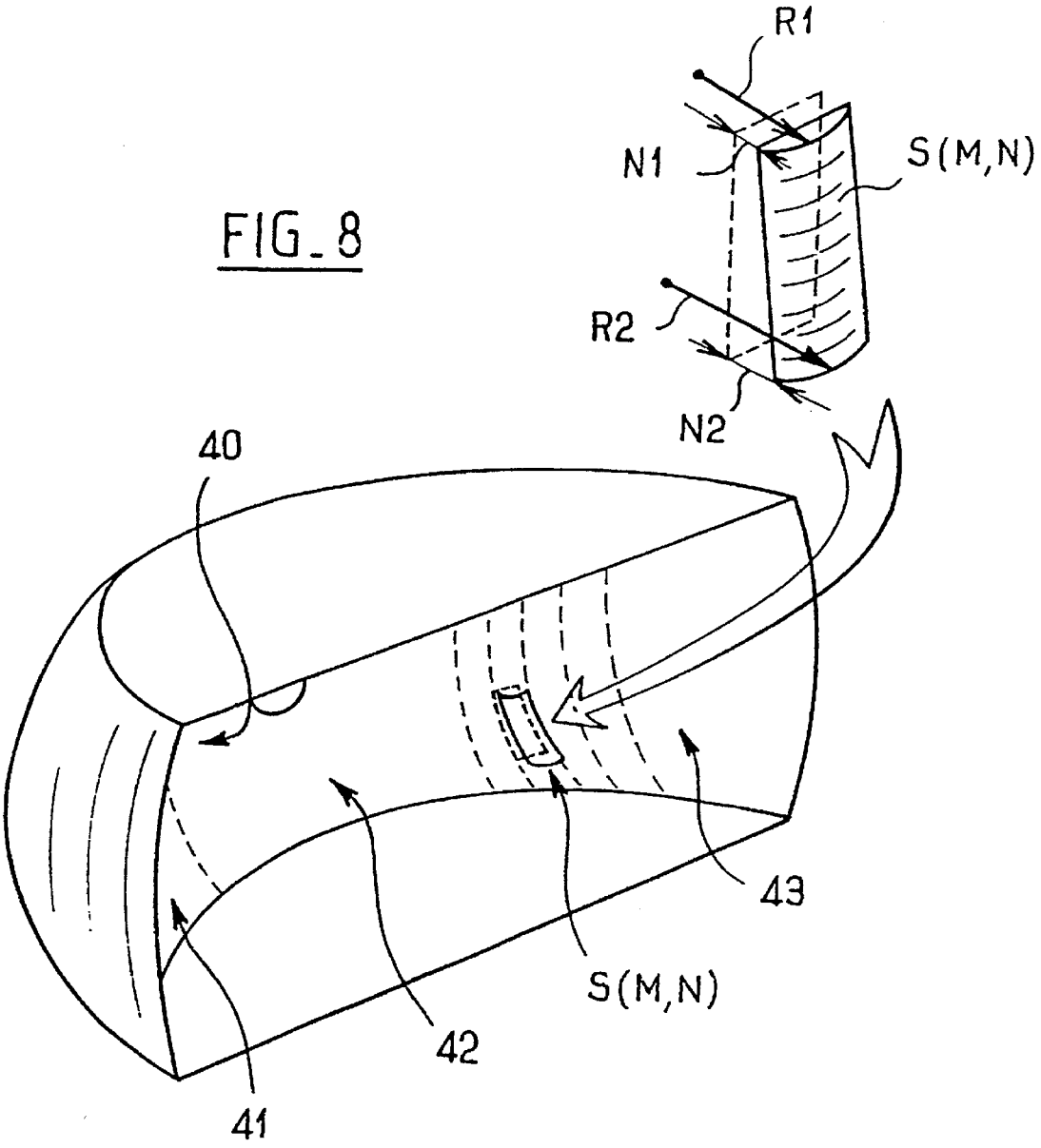
FIG. 8 illustrates a method of forming striations on the base surfaces of the reflector in FIG. 6.

Referring therefore now to FIG. 8, this illustrates the fact that each striation S (M, N) is characterised firstly by radii of curvature R1 and R2 at the upper and lower ends respectively, and secondly by two values of levels N1 and N2 at the two ends of the striation, measured with respect to a base surface. The mathematical method used in order to design the reflective surface of the reflector, from the equations of the base surfaces of the zones 41 and 43 and from the parameters of the striations, will not be described here in any detail. It involves simply an increase in the x coordinate of each point of the equation, calculated as a function of the position of that point on the striation concerned and of the parameters of the striation (i.e. its height, width, radii of curvature R and levels N).

The striation pattern for use when driving on the left is shown in FIG. 6. It comprises a first network of 15×5 striations S (1, 1) to S (15, 5) in the zone 41, and a second network of 15×5 striations S (16, 1) to S (30, 5) in the zone 43. The striations are so arranged as to:

provide some degree of lateral deflection of the light beam produced by the zones 41 and 43, and raise the same light, in the present case in the zone 43, in such a way as to obtain the raised half cut-off line for use when driving on the left, i.e. with no raising in the zone 41.

Zone 41

In the example under consideration, the levels of the striations in the zone 41 are thus all zero, which signifies that the light undergoes no significant vertical deflection. In addition, the ten striations S (14, 1) to S (15, 5) are inoperable as is indicated by the hatched zones, that is to say they are configured with an infinite radius, or a radius which can be regarded as being infinite.

The remaining striations in zone 41 have radii of curvature which vary, preferably between 20 and 40 mm., with a regular distribution, for example, over values of 20, 25, 30, 35 and 40 mm. for widths of the order of 3 to 5 mm.

Figure 9A:
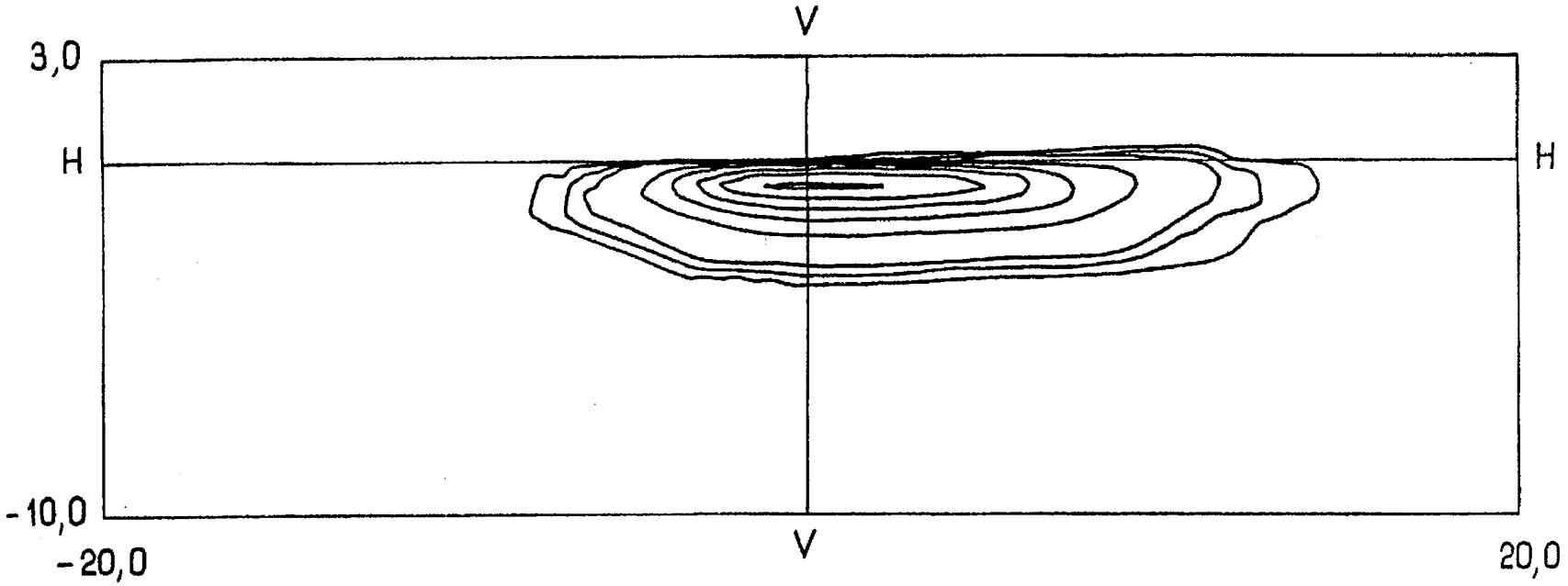
FIGS. 9*a* and 9*b* show, by means of sets of curves along each of which the luminous intensity is constant, the portions of light beams produced by two zones of the reflector of FIG. 6, furnished with striations.

In this way, the light which would normally be produced by the base surface of the zone 41 is deflected horizontally, and FIG. 9*a* shows the result of this deflection.

Zone 43

In the present example, the zone 43 includes a certain number of striations which are inoperative as in the case of the zone 41, these being mainly those striations which lie towards the sides of zone 43. These striations are indicated by narrow hatching. Further striations, indicated in FIG. 6 by broad hatching, are provided as indicated at S (26, 2) to S (30, 2). These striations have a radius of curvature which changes progressively upwards, from a large radius of curvature which can be assimilated into a flatness of the striation, to a reduced radius of curvature which is typically in the range 35 to 40 mm.

The zone 43 also includes a certain number of striations the radius of curvature of which is either fixed or variable, and these particular striations have a level N (FIG. 8) at their upper ends (with respect to the base surface) which is lower than their level at the lower end. In this way, these striations provide some degree of deflection of the light beam; but above all, they dress the beam upwardly so as to define the highest half cut-off line of the beam.

In the present example the striations S (17, 1) to S (30, 1), S (21, 2) to S (30, 2), S (19, 3) to S (30, 3), S (20, 4), S (29, 4), S (30, 4), S (29, 5) and S (30, 5) have this property. By way of example, the differences in level N between the upper and lower edge of each of these striations is preferably in the range between 0.20 and 0.50 mm.

In addition, besides the striations indicated in FIG. 6 by narrow hatching, the striations in the zone 43 have fixed or varying radii of curvature R (FIG. 8) which are preferably spread over a range of values between 20 and 60 mm.

It will finally be observed that, in both the zones 41 and 43, the levels in the radii of curvature of two adjacent superimposed striations, at the level of their horizontal transition, are most preferably identical to each other. In this way there is in the surface, at least in the vertical direction, no interruption or discontinuity which could give rise to optical errors.

Reference is now made to FIG. 9*a*, which shows the appearance of that part of the light beam which is produced by the zone 41 of the striated reflector 40 described above. It will be observed that the light beam is significantly deflected widthwise, without any substantial prejudice to the horizontal cut-off line, lying at the level of the horizon HH, which would be produced by the same surface in the absence of striations.

Figure 9B:
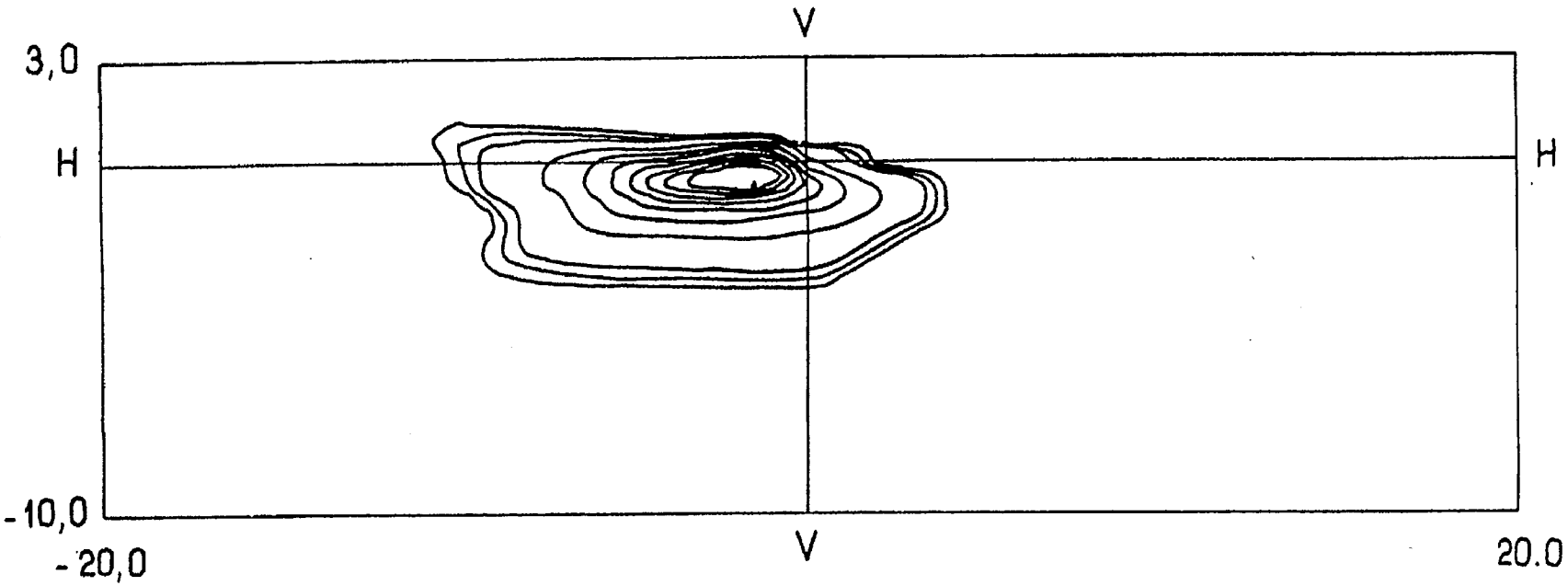

FIG. 9*b* shows that part of the light beam which is produced with the zone 43 of the striated reflector, again as described above. Due to the differences in the level of the striations between their upper and lower ends, the cut-off line is offset upwardly by comparison with that in FIG. 9*a*. At the same time it confers some extra width on the light beam. It will also be noted that, with careful disposition of the striations, the raised cut-off line of the beam extends almost entirely to the left of the central vertical plane VV in the plane of projection.

Figure 9C:
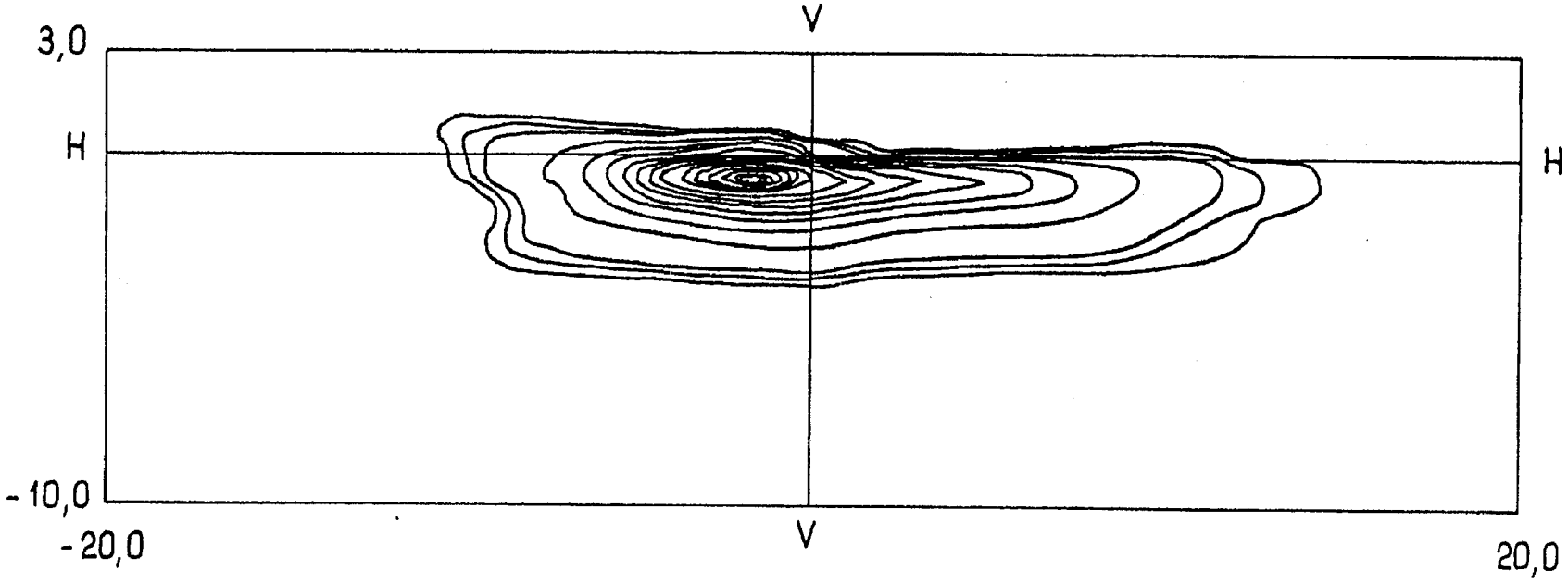
FIG. 9*c* shows, by means of a set of curves along each of which the luminous intensity is constant, the portion of the light beam produced by the two zones mentioned above.

The light beam produced by the zones 41 and 43 together is illustrated in FIG. 9*c*. This diagram shows that a beam having two half cut-off lines staggered in the vertical direction, with the half cut-off line on the left being raised with respect to that on the right (i.e. the beam is adapted for driving on the left) is produced in a most satisfactory way. The beam shown in FIG. 9*c* may also be enriched by the beam shown in FIG. 7*b* which is produced in the central zone 42, so as to give it an even greater width. This leads to improved visual comfort for the driver.

It will be understood that by reversing the arrangement of the striations, that is to say by putting in the zone 41 the striations from zone 43 of FIG. 6, and vice versa, a light beam will be obtained which is symmetrical with that produced by the reflector shown in FIG. 6, that is to say there is now a beam which is adapted for driving on the right.

It will also be observed that, during this reversal, the offsets along the x axis between the surface of FIG. 6 and the symmetrical surface will have a maximum value of the order of 1 mm, with this value corresponding to the difference between the maximum and minimum levels N of the striations, to which the offsets due to the convexity of the striations are added. As a result, it is possible to employ, for mirrors for use in driving on the left and mirrors for use in driving on the right, the same mould cavity. Only the piston part of the mould is different for the two types of reflectors. The mould is consequently less expensive to make.

It will be noted here that, although the headlamp of the invention has been described as having a normalised lamp of type 9006, the invention is in fact applicable to a headlamp with any type of axial filament, other types including, particularly, a lamp of type 9005.

Moreover, a mirror in accordance with the invention may also be used with a lamp of type 9007, which is characterised by two axial filaments which are arranged to give a dipped beam or cruising beam, and a raised or main beam, respectively. In that case, the reflector is designed mainly according to the requirements of the dipped beam which is to be obtained, and, if necessary certain regions of the mirror and cover glass are then adjusted in such a way as to obtain a satisfactory main beam.

The present invention is of course in no way limited to the embodiments described above and shown in the drawings, and the person skilled in the art will be able to apply to it any variation or modification within the spirit of the invention.

What is claimed is:

1. A motor vehicle headlamp comprising: a reflector having a base surface and defining a vertical reference plane; a lamp having an axial filament for emitting light freely substantially all around the lamp; and a cover glass disposed in front of the reflector and lamp, the lamp being so disposed with relation to the reflector, and the reflector being so adapted, that in cooperation with the filament of the lamp, the reflector produces a beam which is delimited by a cut-off line defined essentially by two horizontal half planes which are offset from each other in the vertical direction and which lie on either side of the said vertical reference plane, wherein the reflector has a first lateral edge and a second lateral edge opposite to the first lateral edge, and defines a first zone of the reflector extending along the first lateral edge and over the whole height of the reflector, and a second zone of the reflector extending over the base surface of the latter as far as the said second lateral edge, the reflector further defining, in the said first zone, a first reflective surface for forming a concentrated light beam delimited by a generally straight and horizontal first cut-off line, such that the said beam lies entirely on one side of the said vertical reference plane, the reflector further having, in its said second zone, a second reflective surface for producing a wide beam delimited by a generally straight and horizontal second cut-off line, the reflector further having an upper edge and a lower edge, and means for deflecting the light beam vertically and for defining the said first cut-off line at the level of the higher one of the two said cut-off half planes, the said first and second zones of the reflector defining, at the level of the intersection of the respective said first and second reflective surfaces, a continuous junction line extending from the said upper edge to the said lower edge of the reflector, whereby the said zones are joined continuously together along the said junction line.

2. A headlamp according to claim 1, wherein each said reflective surface is such as to produce images of the filament in which the highest points lie close to the respective cut-off line.

3. A headlamp according to claim 1, wherein the said means for offsetting the light beam vertically comprise means defining an inclination of the said first zone of the reflector through a predetermined vertical angle.

4. A headlamp according to claim 1, wherein the said first zone of the reflector has a smooth base surface, the said means for offsetting the light beam vertically comprising a set of striations formed on the said base surface, each striation having an upper end and a lower end, and at least some of the said striations each having its upper end at a level, with respect to the said base surface, different from the corresponding level of its lower end, whereby to define an offset between the said levels.

5. A headlamp according to claim 4, wherein the said first zone of the reflector has a lower edge and a first base surface, the said base surface of the reflector being an overall base surface comprising: the said first base surface; the surface of the said second zone at the level of the lower edge of the reflector; and a second base surface which is essentially symmetrical to the said first base surface with respect to a vertical axial plane, the said means for offsetting the light beam vertically comprising a first set of striations at the level of one of said first and second base surfaces, together with a second set of striations at the level of the other one of the said second and first base surfaces, in such a way that light beams for driving on the right hand and left hand sides of a road can be produced from the same overall base surface.

6. A headlamp according to claim 5, wherein the reflector is formed by moulding of plastics material in a mould having a common mould cavity for making reflectors for use when driving on the left and when driving on the right.

7. A headlamp according to claim 1, wherein the cover glass is substantially smooth and such as to cause no significant deviation of the light beam.

* * * * *